United States Patent [19]

Parks, Jr. et al.

[11] Patent Number: 4,870,323

[45] Date of Patent: Sep. 26, 1989

[54] METHOD OF DISPENSING MERCURY INTO AN ARC DISCHARGE LAMP

[75] Inventors: Ralph P. Parks, Jr., Danvers; William J. Roche, Merrimac, both of Mass.

[73] Assignee: GTE Products Corporation, Danvers, Mass.

[21] Appl. No.: 218,194

[22] Filed: Jul. 13, 1988

[51] Int. Cl.[4] ..... H01J 61/28

[52] U.S. Cl. ..... 313/546; 313/565; 445/9

[58] Field of Search ..... 313/546, 550, 564, 565, 313/566; 445/9, 10, 16, 53

[56] References Cited

U.S. PATENT DOCUMENTS

| | | | |
|---|---|---|---|
| 2,769,112 | 10/1956 | Heine et al. | 313/318 |
| 2,991,387 | 7/1961 | McCauley | 313/546 X |
| 3,069,580 | 12/1962 | Waymouth, Jr. | 313/631 |
| 3,706,895 | 12/1972 | Martyny et al. | 313/42 |
| 4,204,137 | 5/1980 | Roy | 313/491 |
| 4,454,447 | 6/1984 | Roche et al. | 313/492 |
| 4,494,042 | 1/1985 | Roche | 313/56 |
| 4,553,067 | 11/1985 | Roche et al. | 313/546 |
| 4,754,193 | 6/1988 | Holmes et al. | 313/490 |

*Primary Examiner*—Kenneth Wieder

*Attorney, Agent, or Firm*—Carlo S. Bessone

[57] ABSTRACT

A method of releasing mercury into an arc discharge lamp is disclosed. The method includes the step of disposing an insulating coating (e.g., zirconium dioxide) at the end of the lamp containing a mercury releasing target. The insulating coating is disposed over the lead-in wires, portions of one of the coil electrodes, and a portion of the mercury dispensing target. The main body portion of the target containing the mercury is devoid of the insulating coating. Thereafter, the mercury dispensing target is bombarded with a directed stream of electrons produced by the other coil electrode of sufficient energy to rupture the target causing the mercury to be released. The insulating coating focuses the directed stream of electrons directly on the target, thereby reducing the amount of time necessary to rupture the target.

10 Claims, 1 Drawing Sheet

METHOD OF DISPENSING MERCURY INTO AN ARC DISCHARGE LAMP

TECHNICAL FIELD

This invention relates to low pressure arc discharge lamps, particularly fluorescent lamps, which contain mercury. It is especially concerned with the method by which mercury is introduced into such lamps.

BACKGROUND OF THE INVENTION

Fluorescent lamps are well-known in the art and are used for a variety of types of lighting installations. Such lamps are characterized as low pressure discharge lamps and include an elongated envelope, whose interior surface is coated with a layer of phosphor, and an electrode at each end of the envelope. The envelope also contains a quantity of an ionizable medium such as mercury, and a starting gas at a low pressure, generally in the range of 1 to 5 mm Hg. The starting gas may consist of argon, neon, helium, krypton or a combination thereof.

One of the most commonly used methods for introducing mercury into such lamps is a mechanical dispensing unit which forms part of a so-called exhaust machine. Mercury is dispensed by the action of a slotted plunger passing through a reservoir of mercury and into the closed exhaust chamber housing the exhaust tube. The mercury falls through the exhaust tube into the lamp. This method of dispensing mercury has many drawbacks. In the first place, the mercury dispensing unit complicates the exhaust machine. In the second place, the amount of mercury introduced into the lamp envelope by this method can not be precisely controlled. The lamp during processing is at a high temperature and is in open communication with the exhaust machine. As a result, it is inevitable that a portion of the introduced mercury evaporates and disappears from the lamp, or a portion of the filling gas is driven out of the lamp. Furthermore, the introduction of mercury through the exhaust tube involves the risk of mercury getting stuck in the exhaust tube so that after lamp sealing, the lamp contains too little or no mercury at all. For these reasons a large excess of mercury, namely a multiple of the quantity required by the lamp is generally introduced. Finally, working with mercury on the exhaust machine requires additional safety precautions on medical grounds.

An alternative method of dispensing mercury is to place inside the lamp a mercury compound that is inert under lamp processing conditions but can later be activated to release mercury. Disadvantageously, this method releases impurities, which then require special gettering. Moreover, this method requires a relatively long period of time to activate the mercury compound (e.g., 20 to 30 seconds). As a result, this method of dispensing mercury does not readily lend itself to high speed production machinery.

Another method of introducing mercury into an arc discharge lamp is set forth in U.S. Pat. No. 4,553,067 which issued to Roche et al on Nov. 12, 1985 and is assigned to the same Assignee as the present Application. Therein a mercury dispensing target is located within an exhausted lamp having a coil at each end of the lamp. The dispensing target is affixed to a lead-in wire adjacent one of the coils. During processing, the mercury target is heated by bombarding the target with a directed stream of electrons produced by one of the coils which causes the contained mercury to be released. Although this method reduces mercury release times to 3.5 seconds, it is desirable to obtain further reductions.

According to the teachings of the present invention, portions of the mount structure at a single end of the lamp are coated with an insulating coating except for a portion of the mercury target so as to focus the directed stream of electrons during the mercury releasing process on the main body of the mercury target (i.e., the portion containing the mercury). As a result, the time needed to release mercury into the lamp is significantly reduced.

Insulating coatings have been used in fluorescent lamps without mercury releasing targets for the purpose of reducing or preventing end discoloration. Generally, all non-electron emissive internal metal parts of the lamp which are exposed to ion bombardment during normal lamp operation can be coated. For a.c. lamp operation, portions of the mount structure at both ends of the lamp are provided with the insulating coating. U.S. Pat. No. 2,769,112, for example, which issued to Heine et al on Oct. 30, 1956, teaches the application of a refractory insulating oxide (e.g., zirconium oxide) to all metal parts except the cathode in an effort to cure the brown patch or end band problem. U.S. Pat. No. 3,069,580, which issued to Waymouth, Jr. on Dec. 18, 1962, teaches the use of refractory insulating cements over the lead-in wires so that the cathode coil will take all of the electron current during the anode half cycle. U.S. Pat. No. 3,706,895, which issued to Martyny et al on Dec. 19, 1972, teaches the use a coating of a polyimide plastic containing zirconium oxide on portions of the lead-in wires. As stated therein, the coating retards end darkening and will reduce or eliminate brown patches which are caused by ion induced sputtering of the lead wire. U.S. Pat. No. 4,204,137, which issued to Roy on May 20, 1980, teaches coating the portions of the electrode support wires which are exposed to ion bombardment within the body of the lamp with a refractory material such as boron nitride. As stated in this patent, the coating improves the life of lamps by reducing end blackening.

SUMMARY OF THE INVENTION

It is, therefore, an object of the invention to obviate the disadvantages of the prior art.

It is another object of the invention to enhance the dispensing of mercury into an arc discharge lamp.

It is still another object of the invention to further reduce the amount of time required to release mercury into an arc discharge lamp.

It is still another object of the invention to provide a method of dispensing mercury into a lamp in a manner which lends itself to high speed production machinery.

These objects are accomplished, in one aspect of the invention, by the provision of an arc discharge lamp for a.c. operation having an envelope of light-transmitting vitreous material having opposing end portions and containing an inert starting gas. The lamp further includes first and second coil electrodes respectively located within the opposing end portions. First and second pairs of lead-in wires respectively connect the first and second electrodes. A metal mercury dispensing target is adjacent the first coil electrode and is electrically connected to one of the first pair of lead-in wires.

The mercury dispensing target defines a main body portion and an end portion.

The improvement comprises an insulating coating disposed over at least the portions of the lead-in wires proximate the first coil electrode, the portions of the first coil electrode proximate the ends of the first pair of lead-in wires, and a portion of the metal mercury dispensing target. At least a portion of the main body portion of the mercury dispensing target is devoid of the insulating coating.

In accordance with further aspects of the present invention, the insulating coating is preferably zirconium dioxide.

In accordance with the teachings of the invention, the insulating coating is disposed on the end portion of the mercury dispensing target. Preferably, substantially all of the main body portion of the mercury dispensing target is devoid of the insulating coating. In one embodiment, the insulating coating is completely disposed over the first pair of lead-in wires.

In accordance with another aspect of the present invention, there is defined a method of releasing mercury into an arc discharge lamp. The method includes the steps of disposing an insulating coating over at least the portions of the first pair of lead-in wires proximate the first coil electrode. The portions of the first coil electrode proximate the ends of the first pair of lead-in wires, and a portion of the mercury dispensing target such that a portion of the main body portion of the mercury dispensing target is devoid of the insulating coating. The mercury dispensing target is bombarded with a directed stream of electrons of sufficient energy to heat the mercury dispensing target and release mercury.

BRIEF DESCRIPTION OF THE DRAWINGS

The invention will become more readily apparent from the following exemplary description in connection with the accompanying drawings, wherein.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 1:
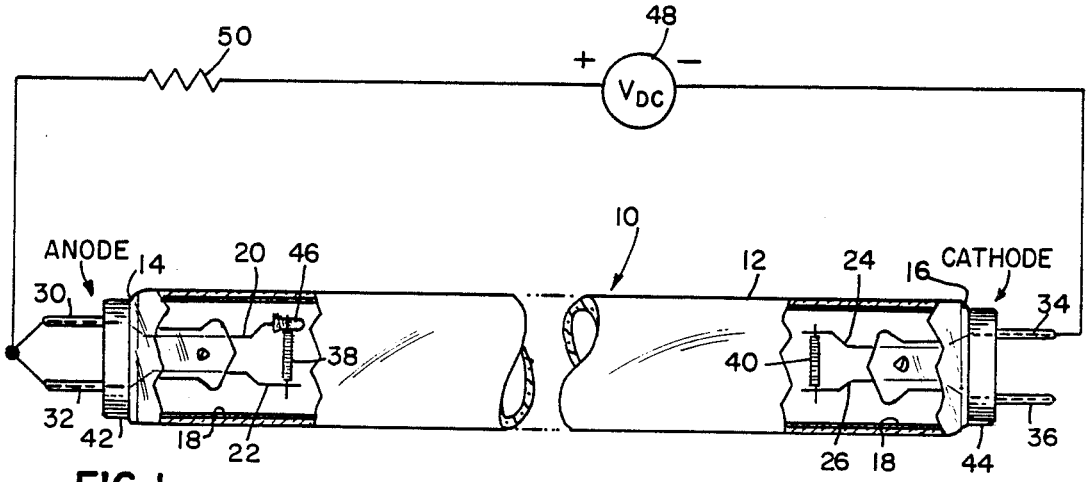
FIG. 1 is a partly broken away, perspective view of an arc discharge lamp electrically connected to a circuit employable in releasing mercury according to the invention.
Figure 2:
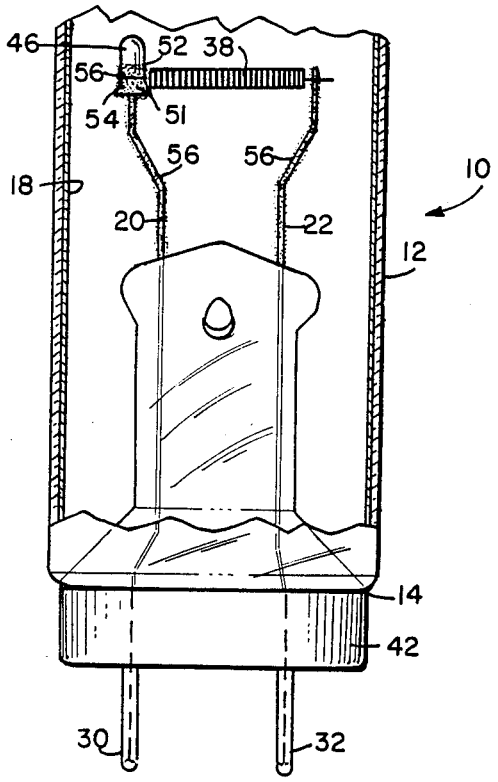
FIG. 2 an enlarged, perspective view of a portion of the arc discharge lamp in FIG. 1.

Referring now to the drawings with greater particularity, there is shown in FIGS. 1 and 2 a fluorescent arc discharge lamp 10 having a sealed envelope 12 of light-transmitting vitreous material. Envelope 12 has opposing end portions 14, 16, and encloses an inert starting gas. The starting gas may consist of argon, neon, helium, krypton or a combination thereof at a low pressure in the range of about 1 to 5 mm Hg.

A first coil electrode 38 and a second coil electrode 40 are located within opposing end portions 14 and 16, respectively. Electrodes 38, 40 are coated with electron-emitting materials such as BaO-SrO-CaO. A first pair of lead-in wires 20, 22 connects first electrode 38 and a second pair of lead-in wires 24, 26 connect second electrode 40. Suitable bases 42, 44 carrying contacts 30, 32 and 34, 36 are respectively sealed adjacent end portions 14, 16. Lead-in wires 20, 22 and 24, 26 are electrically connected to contacts 30, 32 and 34, 36, respectively.

A phosphor coating 18 is disposed on the interior surface of envelope 12. Phosphor coating 18 is responsive to the ultraviolet radiation generated by the plasma discharge to provide the desired emission spectrum.

As further shown in FIGS. 1 and 2, fluorescent arc discharge lamp 10 contains a mercury dispensing target such as a metal capsule 46 electrically connected to lead-in wire 20 adjacent first electrode 38. Mercury capsule 46 extends from lead-in wire 20 and electrically forms a part thereof by being spot welded to the lead-in wire at spot 51. Mercury capsule 46 has a tubular-shaped main body portion 52 which prior to processing encloses a quantity of mercury. As best illustrated in FIG. 1, main body portion 52 of capsule 46 extends above the plane of coil 38 toward the center of lamp 10 so as to be a direct target for electron bombardment. The mercury is sealed within the main body portion of the capsule by means of a flattened end portion 54. The mercury may be sealed within the capsule, for example, by utilizing the teachings of U.S. Pat. No. 4,754,193, issued on June 28, 1988 and assigned to the same Assignee as the present Application.

In accordance with the teachings of the present invention, an insulating coating 56 is disposed over the portions of the first pair of lead-in wires 20, 22 proximate the first coil electrode 38 (i.e., the areas where the lead-in wires are clamped to the coil electrode). If desired, the insulating coating may extend from the clamp area to the location where the wires emerge from glass seal area. The insulating coating extends over the portions of coil 38 between each clamp and the electron-emitting material on the coil electrode. As best shown in FIG. 2, flattened end portion 54 is generally coated with the insulating coating. At least a portion of main body 52 of capsule 46 is devoid of the coating so that this portion of the capsule which contains the mercury will be exposed to the stream of electrons used to rupture the capsule.

Preferably, the insulating coating is in the form of zirconium dioxide ($ZrO_2$). It will become apparent to those skilled in the art that other insulating coatings can also be used. It should be noted that only lamp end 14 containing the mercury dispensing target needs to be coated with the insulating coating. End 16 of lamp 10 is generally devoid of the insulating coating.

The basic circuit arrangement for utilizing electron current to release the mercury is shown in FIG. 1 as comprising a d.c. power supply 48 and a current-limiting resistor 50. The end of the lamp 10 containing the mount to which the mercury target is attached is connected to the positive side of power supply 48. The other end of lamp 10 is connected to the negative side of power supply 48.

The current drawn through fluorescent lamp 10 during the capsule rupturing process is essentially electron current. The primary source of electron current within lamp 10 is the lamp cathode which in the d.c. circuit is the electrode 40 connected to the negative side of the power supply 48. The primary electron current generates secondary electrons through an ionization process in the positive column of the evacuated, filled and sealed lamp. These electrons have a random thermal velocity as well as a drift velocity established by the lamp field in the direction from cathode-to-anode. Electrons arriving at the positive end of the lamp will be collected by the portions of electrode 38, lead-in wires 20, 22, and mercury target 46 which are uncoated with the insulating coating. The electron collection process converts the kinetic energy of the electron current into heat energy. The quantity of heat energy produced will depend on the kinetic energy of electrons which is directly relatable to the anode sheath voltage. The anode sheath voltage is related to the lamp current and the electron collector surface area by the equation $$V_S=(KT_e/q)\ln(I_L/J_rA_c)$$

where:

$V_s$ is the anode sheath voltage
K is the Boltzmann gas constant
$T_e$ is the electron gas temperature
q is the electronic charge
ln is the natural logrithmic function
$I_L$ is the lamp current
$J_r$ is the random electron current density
$A_c$ is the electron collector surface area.

By increasing the lamp current and reducing the size of the collector surface by the use of the insulating coating, the value of the sheath voltage is increased.

The power dissipated in the anode will be equal to the product of the sheath voltage and the lamp current.

$$P=V_SI_L=(KT_e/q)\ln(I_L/J_rA_c)$$

Although the rupture circuit illustrated in FIG. 1 uses direct current, the lamp is generally intended for use on an alternating current circuit.

It has been discovered that by using the insulating coating according to the present invention, the amount of time needed to release mercury can be significantly reduced. The insulating coating focuses the electrons during rupture of the capsule on the capsule itself.

In a typical but non-limitative example, mercury capsule 46 was formed from a generally tubular metal cup made from Alloy 4 and having a smaller diameter tubular portion of 0.060 inch (1.52 millimeters) outer diameter (O.D.), a wall thickness of approximately 0.0030 inch (0.076 millimeter) and a length L of 0.344 inch (0.873 centimeters). Approximately 16 milligrams of mercury was dispensed into the capsule through an open end. A sealed end portion was formed by crimping the end portion of the capsule. The formed mercury capsule was secured to one of the lead-in wires adjacent one of the electrodes in an F96T12 fluorescent lamp as shown in FIGS. 1 and 2. Zirconium dioxide completely coated the lead-in wires including the clamps at the end of the lamp containing the mercury capsule. The portions of coil between each clamp and the electron-emitting material on the coil electrode were also coated with zirconium dioxide. The coating extended over the flattened end portion of the capsule. The entire main body portion of the capsule was devoid of the insulating coating so that the portion of the capsule containing the mercury would be exposed to the stream of electrons used to rupture the capsule.

After the lamps were evacuated and sealed, the mercury in the capsules was released by heating the capsules to an elevated temperature sufficient to cause capsule rupture by using the apparatus illustrated in FIG. 1. The activation current was 600 milliamps.

A group of lamps similar to those described in the above example without the insulating coating was processed in a similar manner. TABLE I below shows the resulting mercury release times.

TABLE I

| | Avg. release time (seconds) |
|---|---|
| Lamps with $ZrO_2$ coating | 1.22 |
| Lamps without coating | 2.12 |

The use of the insulating coating on the lead-in wires resulted in a 42.5% improvement in mercury release time.

There has thus been shown and described a method of releasing mercury into an arc discharge lamp which reduces the amount of time needed to dispense the mercury. Because of the relatively short release times, the method lends itself to high speed production machinery.

While there have been shown and described what are at present considered to be the preferred embodiments of the invention, it will be apparent to those skilled in the art that various changes and modifications can be made herein without departing from the scope of the invention. The embodiments shown in the drawings and described in the specification are intended to best explain the principles of the invention and its practical application to hereby enable others in the art to best utilize the invention in various embodiments and with various modifications as are suited to the particular use contemplated.

What is claimed is:

1. In an arc discharge lamp for a.c. operation having an envelope of light-transmitting vitreous material having opposing end portions and containing an inert starting gas, first and second coil electrodes respectively located within said opposing end portions, portions of said first and second coils having as emissive material thereof, first and second pairs of lead-in wires respectively connecting said first and second electrodes, a metal mercury dispensing target adjacent said first coil electrode and electrically connected to one of said first pair of lead-in wires and extending therefrom, portions of said mercury dispensing target defining a main body portion and an end portion, the improvement comprising:

an insulating coating disposed over the portions of said first pair of lead-in wires proximate said first coil electrode, the portions of said first coil electrode proximate the ends of said first pair of lead-in wires, and a portion of said metal mercury dispensing target, a portion of said main body portion of said metal mercury dispensing target being devoid of said insulating coating so as to focus a directed stream of electrons during the mercury releasing process on said portion of said main body of said mercury dispensing target devoid of said insulating coating.

2. The improvement according to claim 1 wherein said insulating coating is zirconium dioxide.

3. The improvement according to claim 1 wherein said insulating coating is disposed on said end portion of said mercury dispensing target.

4. The improvement according to claim 1 wherein substantially all of said main body portion of said mercury dispensing target is devoid of said insulating coating.

5. The improvement according to claim 1 wherein said insulating coating is disposed completely over said first pair of lead-in wires.

6. The method of releasing mercury into an arc discharge lamp having an envelope having opposing end portions and containing an inert starting gas, first and second coil electrodes respectively located within said opposing end portions, first and second pairs of lead-in wires respectively connecting said first and second electrodes, a metal mercury dispensing target adjacent said first coil electrode and electrically connected to one of said first pair of lead-in wires and extending therefrom, portions of said mercury dispensing target defining a main body portion and an end portion, said method comprising the steps of:

disposing an insulating coating over at least the portions of said first pair of lead-in wires proximate said first coil electrode, the portions of said first coil electrode proximate the ends of said first pair of lead-in wires, and a portion of said metal mercury dispensing target such that a portion of said main body portion of said metal mercury dispensing target is devoid of said insulating coating; and bombarding said portion of said main body portion of said mercury dispensing target devoid of said insulating coating with a directed stream of electrons of sufficient energy to heat said target and release mercury.

7. The method according to claim 6 wherein said insulating coating is zirconium dioxide.

8. The method according to claim 6 including the step of disposing said insulating coating on said end portion of said mercury dispensing target.

9. The method according to claim 6 including the step of not disposing said insulating coating on substantially all of said main body portion of said mercury dispensing target.

10. The method according to claim 6 including the step of disposing said insulating coating completely over said first pair of lead-in wires.

* * * * *